US007628048B2

(12) United States Patent
Huang et al.

(10) Patent No.: US 7,628,048 B2
(45) Date of Patent: Dec. 8, 2009

(54) REKEYABLE LOCK CYLINDER AND METHOD FOR REKEYING THE SAME

(75) Inventors: Chao-Ming Huang, Gangshan Town (TW); Chi-Ming Chen, Kaohsiung County (TW)

(73) Assignee: Taiwan Fu Hsing Industrial Co., Ltd., Kaohsiung County (TW)

( * ) Notice: Subject to any disclaimer, the term of this patent is extended or adjusted under 35 U.S.C. 154(b) by 0 days.

(21) Appl. No.: 12/433,066

(22) Filed: Apr. 30, 2009

(65) Prior Publication Data

US 2009/0277234 A1 Nov. 12, 2009

Related U.S. Application Data

(63) Continuation-in-part of application No. 12/149,757, filed on May 7, 2008.

(51) Int. Cl.
*E05B 27/04* (2006.01)
*E05B 29/06* (2006.01)

(52) U.S. Cl. ..... 70/338; 70/340; 70/368; 70/383; 70/384; 70/492; 70/493; 70/495

(58) Field of Classification Search ..... 70/337–343, 70/368, 382–385, 492–496
See application file for complete search history.

(56) References Cited

U.S. PATENT DOCUMENTS

| | | | | | |
|---|---|---|---|---|---|
| 3,589,153 | A * | 6/1971 | Hill | ..... | 70/384 |
| 4,376,382 | A * | 3/1983 | Raymond et al. | ..... | 70/338 |
| 4,747,281 | A * | 5/1988 | Monahan | ..... | 70/383 |
| 4,836,002 | A * | 6/1989 | Monahan | ..... | 70/382 |
| 4,966,021 | A * | 10/1990 | Boag | ..... | 70/383 |
| 5,752,400 | A * | 5/1998 | Kim | ..... | 70/368 |
| 6,041,631 | A * | 3/2000 | Vonlanthen | ..... | 70/492 |
| 6,119,495 | A * | 9/2000 | Loreti | ..... | 70/340 |
| 7,007,528 | B2 * | 3/2006 | Chong et al. | ..... | 70/492 |
| 7,424,815 | B1 * | 9/2008 | Pagnoncelli | ..... | 70/340 |
| 7,448,239 | B1 * | 11/2008 | Huang et al. | ..... | 70/360 |
| 7,448,240 | B1 * | 11/2008 | Huang et al. | ..... | 70/492 |
| 7,526,935 | B2 * | 5/2009 | Huang et al. | ..... | 70/360 |
| 2003/0089149 | A1 * | 5/2003 | Suzuki et al. | ..... | 70/492 |
| 2006/0101880 | A1 * | 5/2006 | Ward-Dolkas et al. | ..... | 70/492 |
| 2008/0264127 | A1 * | 10/2008 | Chiang et al. | ..... | 70/492 |

FOREIGN PATENT DOCUMENTS

JP 7197705 * 8/1995

* cited by examiner

*Primary Examiner*—Lloyd A Gall

(57) ABSTRACT

A rekeyable lock cylinder comprises a cylinder body and a plug assembly disposed within the cylinder body. The plug assembly comprises a plug body, a plurality of assembled pins, a position block and a rotating member. The plug body has a longitudinal axis, a transverse axis perpendicular to the longitudinal axis and a first through hole. Each of the assembled pins is movably disposed in the plug body and comprises a first rack component and a second rack component selectively engaging with the first rack component. The position block is disposed at the plug body and has a plurality of pin runners for disposing the first rack components and a second through hole corresponding to the first through hole. The rotating member is installed penetrating the first through hole and the second through hole and has a contacting portion located within the second through hole, wherein the position block is capable of being pushed by the contacting portion and moved along the transverse axis-direction of the plug body for disengaging the first rack components from the second rack components.

12 Claims, 10 Drawing Sheets

REKEYABLE LOCK CYLINDER AND METHOD FOR REKEYING THE SAME

This is a continuation in part application of applicant's U.S. patent application Ser. No. 12/149,757, filed on May 7, 2008.

FIELD OF THE INVENTION

The present invention is generally relating to a rekeyable lock cylinder and method for rekeying the same.

BACKGROUND OF THE INVENTION

Lock cylinder of the known lock device is normally matched with a proper key so lock cylinder as well as key must be replaced in pair at the time of replacing a lock for safety or other special reasons, which results in high cost and inconvenience in use.

SUMMARY

The primary object of the present invention is to provide a rekeyable lock cylinder and method for rekeying the same. First, a first matched key is inserted into a plug body and then turned to drive the plug body and a position block turning. Next, a rotating member is turned to push the position block and make the first rack components move along a transverse axis-direction of the plug body for disengaging from the second rack components. Then, the first matched key is pulled out prior to inserting a second matched key into the plug body. Finally, the rotating member is turned to reengage the first rack components with the second rack components. Accordingly, the present invention is capable of providing advantages of widely lowering rekeying cost and enhancing convenience in use, because lock-replacing process can be completed as soon as rekeying another matched key only without replacing lock cylinder.

A rekeyable lock cylinder in accordance with the present invention comprises a cylinder body and a plug assembly disposed within the cylinder body. The plug assembly comprises a plug body, a plurality of assembled pins, a position block and a rotating member, wherein the plug body has a longitudinal axis, a transverse axis perpendicular to the longitudinal axis and a first through hole, each of the assembled pins movably disposed at the plug body comprises a first rack component and a second rack component selectively engaging with the first rack component, the position block disposed at the plug body has a plurality of pin runners servicing for disposing the first rack components and a second through hole corresponding to the first through hole, and the rotating member installed penetrating the first through hole of the plug body and the second through hole of the position block has a contacting portion located within the second through hole. The contacting portion is capable of pushing the position block and makes it to move along the transverse axis-direction of the plug body for disengaging the first rack components from the second rack components.

In accordance with rekeying method of a rekeyable lock cylinder of the present invention, first a rekeyable lock cylinder is provided comprising a plug body, a position block disposed at the plug body, a rotating member installed penetrating the position block and a plurality of assembled pins, wherein the plug body has a transverse axis, each of the assembled pins at least comprises a first rack component and a second rack component engaging with the first rack component. Next, a first matched key is inserted into the plug body and then turned to drive the plug body and the position block turning. Next, the rotating member is turned to push the position block that makes the first rack components move along the transverse axis-direction of the plug body for disengaging from the second rack components. Then, a second matched key is inserted into the plug body after pulling the first matched key out. Finally, the first rack components reengage with the second rack components by means of turning the rotating member.

DETAILED DESCRIPTION OF THE INVENTION

Figure 1:
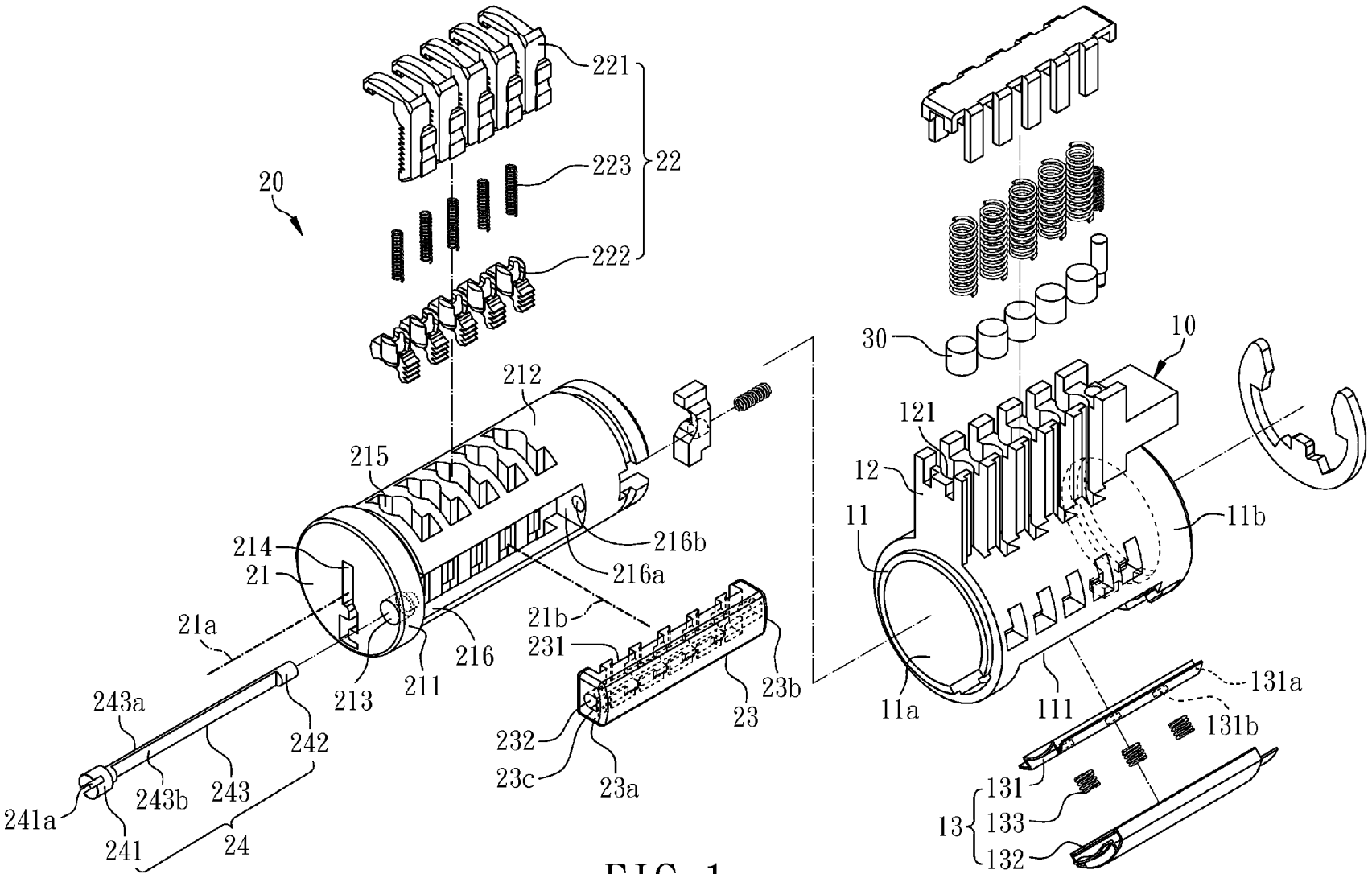
FIG. 1 is a perspective exploded view illustrating a rekeyable lock cylinder in accordance with a preferred embodiment of the present invention.
Figure 2:
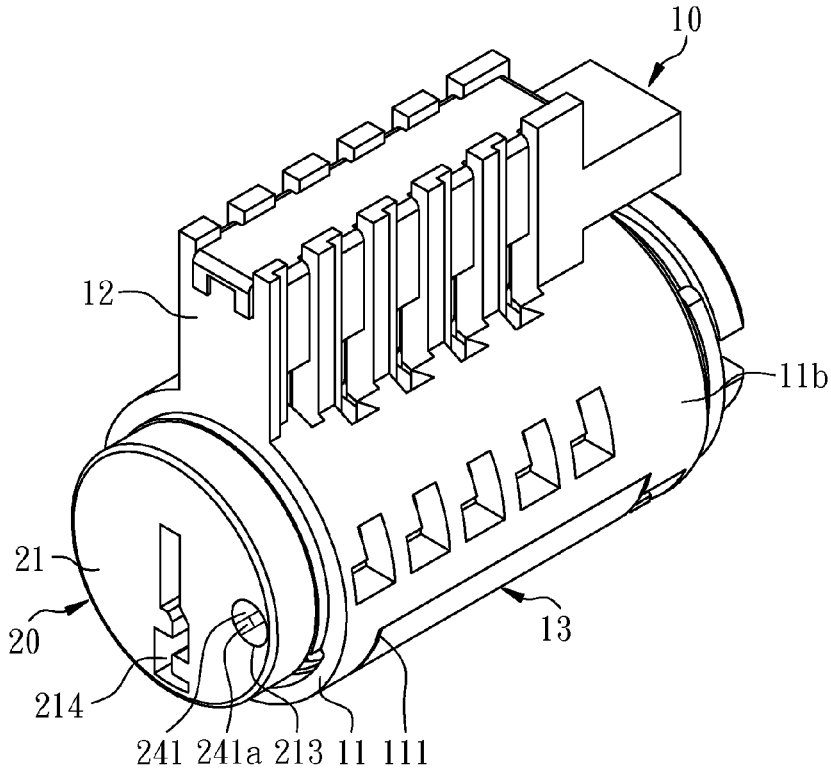
FIG. 2 is a perspective assembled view illustrating the rekeyable lock cylinder.
Figure 4:
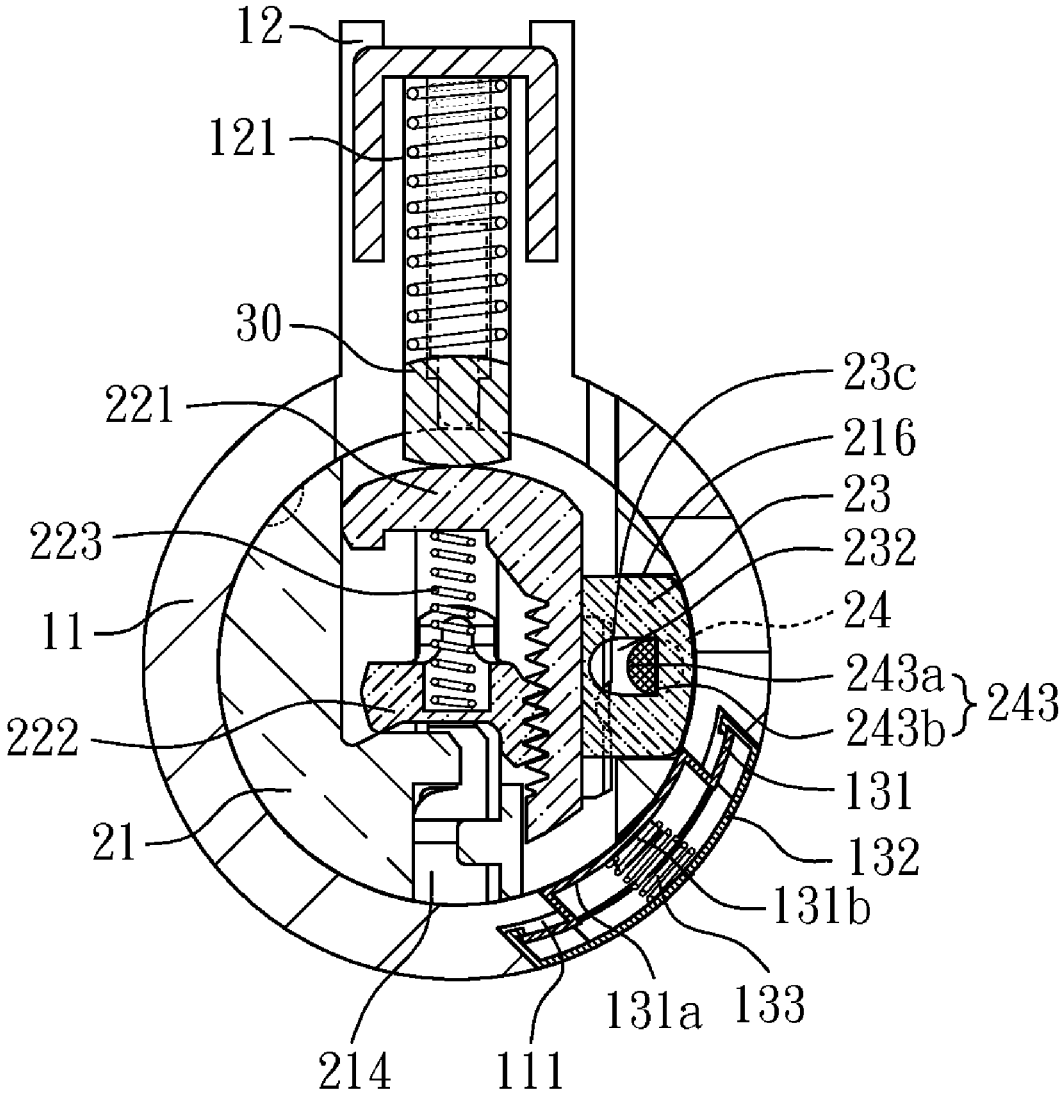
FIG. 4 is an assembled longitudinal section view illustrating the rekeyable lock cylinder.

With reference to FIGS. 1 and 2, a rekeyable lock cylinder in accordance with a preferred embodiment of the present invention comprises a cylinder body 10, a plug assembly 20 disposed within the cylinder body 10 and a plurality of upper pins 30. The cylinder body 10 comprises a hollow cylinder portion 11 for disposing the plug assembly 20, an extending protrusion 12 formed at one side of the hollow cylinder portion 11 and a resilient assembly 13 disposed at the hollow cylinder portion 11, or the extending protrusion 12 is capable of being omitted from the cylinder body 10 in another embodiment. In this embodiment, the hollow cylinder portion 11 has an inner wall 11*a*, an outside wall 11*b* and a recession 111 recessed from the inner wall 11*a* and communicating with the inner wall 11*a* and the outside wall 11*b*. The extending protrusion 12 has a plurality of upper pin holes 121 in communication with the hollow cylinder portion 11. With reference to FIGS. 1, 2 and 4, the resilient assembly 13 disposed within the recession 111 of the hollow cylinder portion 11 comprises a movable plate 131, an immovable plate 132 fixed at the recession 111 and at least one resilient member 133 disposed between the movable plate 131 and the immovable plate 132. In this embodiment, the movable plate 131 is transversely movable within the recession 111 and has a surface 131*a* facing the resilient member 133 and at least one pillar 131*b* projecting from the surface 131*a*. Preferably, the resilient member 133 is disposed at the pillar 131*b* of the movable plate 131 and two ends of the resilient member 133 contact against the movable plate 131 and the immovable plate 132 respectively.

Figure 3:
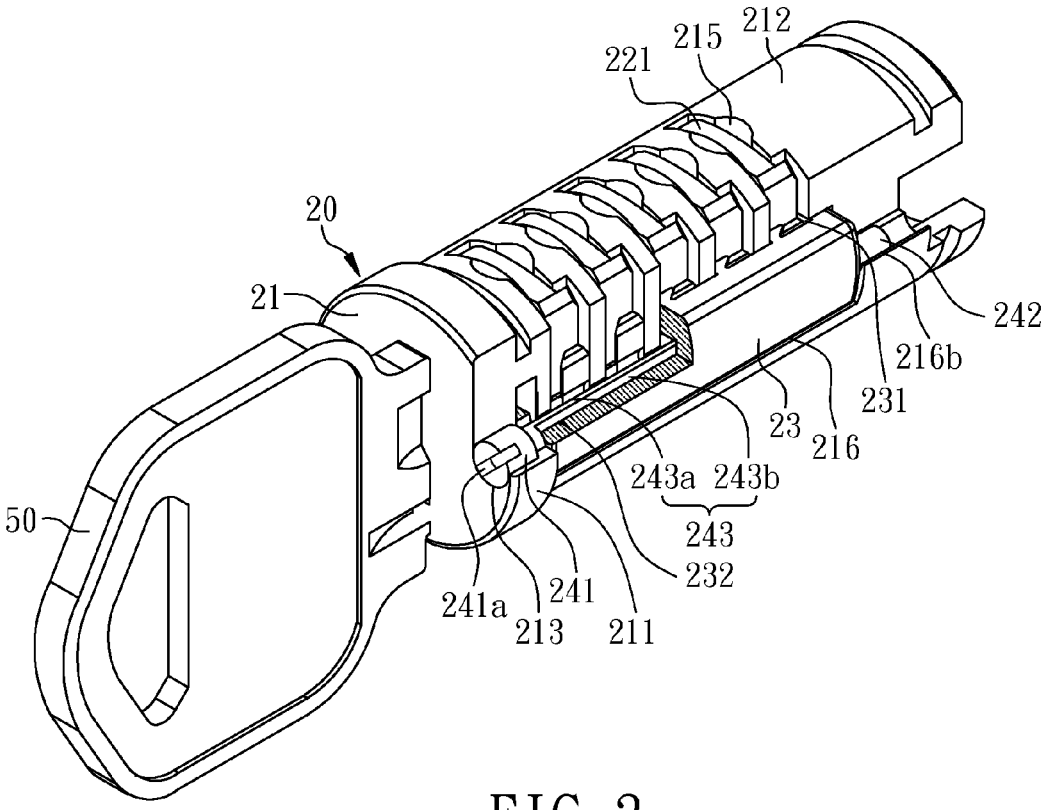
FIG. 3 is a partial section view illustrating a plug assembly in accordance with a preferred embodiment of the present invention.
Figure 13:
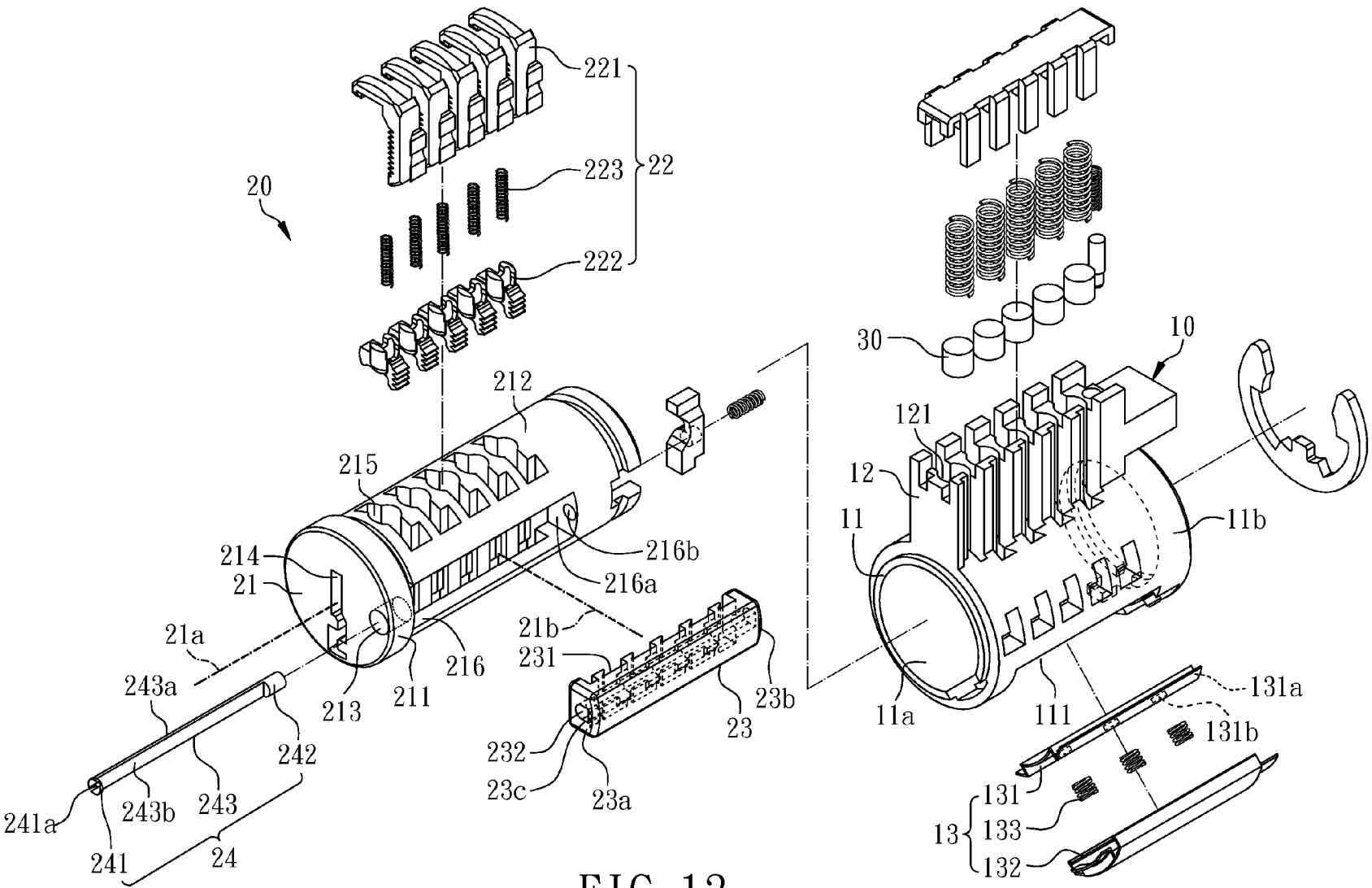
FIG. 13 is a perspective exploded view illustrating another rekeyable lock cylinder in accordance with another preferred embodiment of the present invention.
Figure 14:
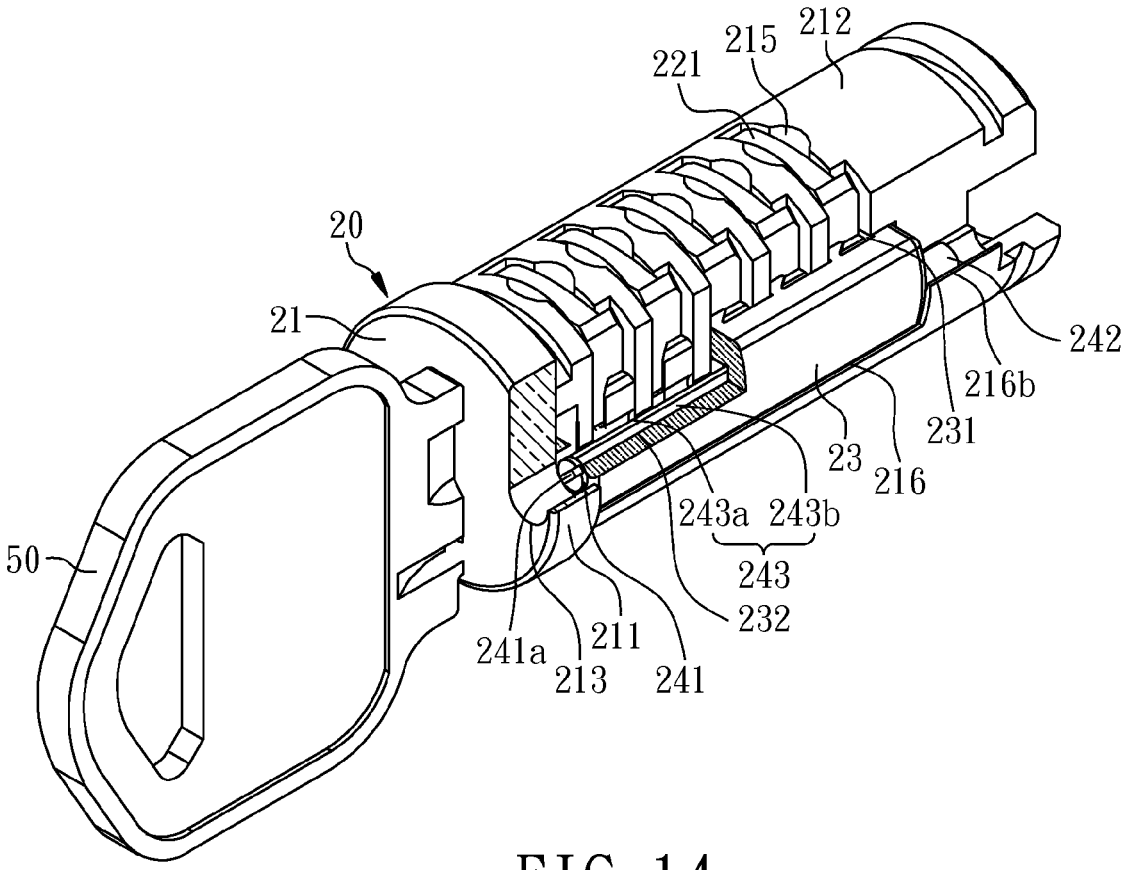
FIG. 14 is a partial section view illustrating another plug assembly in accordance with another preferred embodiment of the present invention.

With reference to FIGS. 1 and 3, the plug assembly 20 comprises a plug body 21, a plurality of assembled pins 22, a position block 23 and a rotating member 24. The plug body 21 has a longitudinal axis 21*a*, a transverse axis 21*b* perpendicular to the longitudinal axis 21*a*, a front portion 211, a rear portion 212, a first through hole 213 penetrating the front portion 211 and a keyhole 214. In this embodiment, the rear portion 212 has a plurality of pin holes 215 for disposing the assembled pins 22 and a trench 216 in communication with the pin holes 215, wherein the trench 216 has a trench wall 216*a* facing the first through hole 213 and a tool-fixing hole 216*b* recessed from the trench wall 216*a*, and preferably the tool-fixing hole 216*b* is capable of corresponding to the first through hole 213. Besides, the first through hole 213 communicates with the trench 216. With reference again to FIGS. 1, 3 and 4, the assembled pins 22 are movably disposed in the pin holes 215 of the plug body 21. In this embodiment, the assembled pins 22 are height-adjustable pins and each of the assembled pins 22 comprises a first rack component 221, a second rack component 222 selectively engaging with the first rack component 221 and an elastic component 223 disposed between the first rack component 221 and the second rack component 222. With reference again to FIGS. 1, 3 and 4, the position block 23 disposed at the trench 216 of the rear portion 212 of the plug body 21 has a first side 23*a* facing the first through hole 213, a second side 23*b* opposite to the first side 23*a*, a plurality of pin runners 231 for disposing the first rack components 221, a second through hole 232 corresponding to the first through hole 213 and an inside wall 23*c* located within the second through hole 232. The second through hole 232 communicates with the first side 23*a* and the second side 23*b*, and also communicates with the pin runners 231 in this embodiment. With reference again to FIGS. 1, 3 and 4, the rotating member 24 is installed penetrating the first through hole 213 of the plug body 21 and the second through hole 232 of the position block 23 in this embodiment, or with reference to FIGS. 13 and 14 in another embodiment, it may install penetrating the second through hole 232 of the position block 23 only and turn the rotating member 24 via the first through hole 213 of the plug body 21 by utilizing a tool (not shown in the drawing). The rotating member 24, shown in FIGS. 1, 3 and 4, has a first end 241 pivotally disposed at the front portion 211 of the plug body 21, a second end 242 pivotally disposed at the rear portion 212 of the plug body 21 and a contacting portion 243 connecting the first end 241 and the second end 242. In this embodiment, the second end 242 of the rotating member 24 is pivotally disposed at the tool-fixing hole 216*b* of the plug body 21, and the first end 241 of the rotating member 24 has a tool-turning groove 241*a* provided for inserting a tool to turn the rotating member 24, or the first end 241 of the rotating member 24 may have a turning plate (not shown in the drawing) for turning the rotating member 24 in another embodiment. With reference again to FIGS. 1, 3 and 4, the contacting portion 243 of the rotating member 24 is located within the second through hole 232 of the position block 23 and has an arc sidewall 243*a* and a lateral 243*b* disposed in opposition to the arc sidewall 243*a*. The contacting portion 243 may have a shape of semicircle, triangle or ellipse, and is in shape of semicircle in this embodiment. With reference again to FIGS. 1 and 2, the upper pins 30 may be movably disposed at the upper pin holes 121 of the extending protrusion 12 of the cylinder body 10 and the pin holes 215 of the rear portion 212 of the plug body 21.

Figure 5:
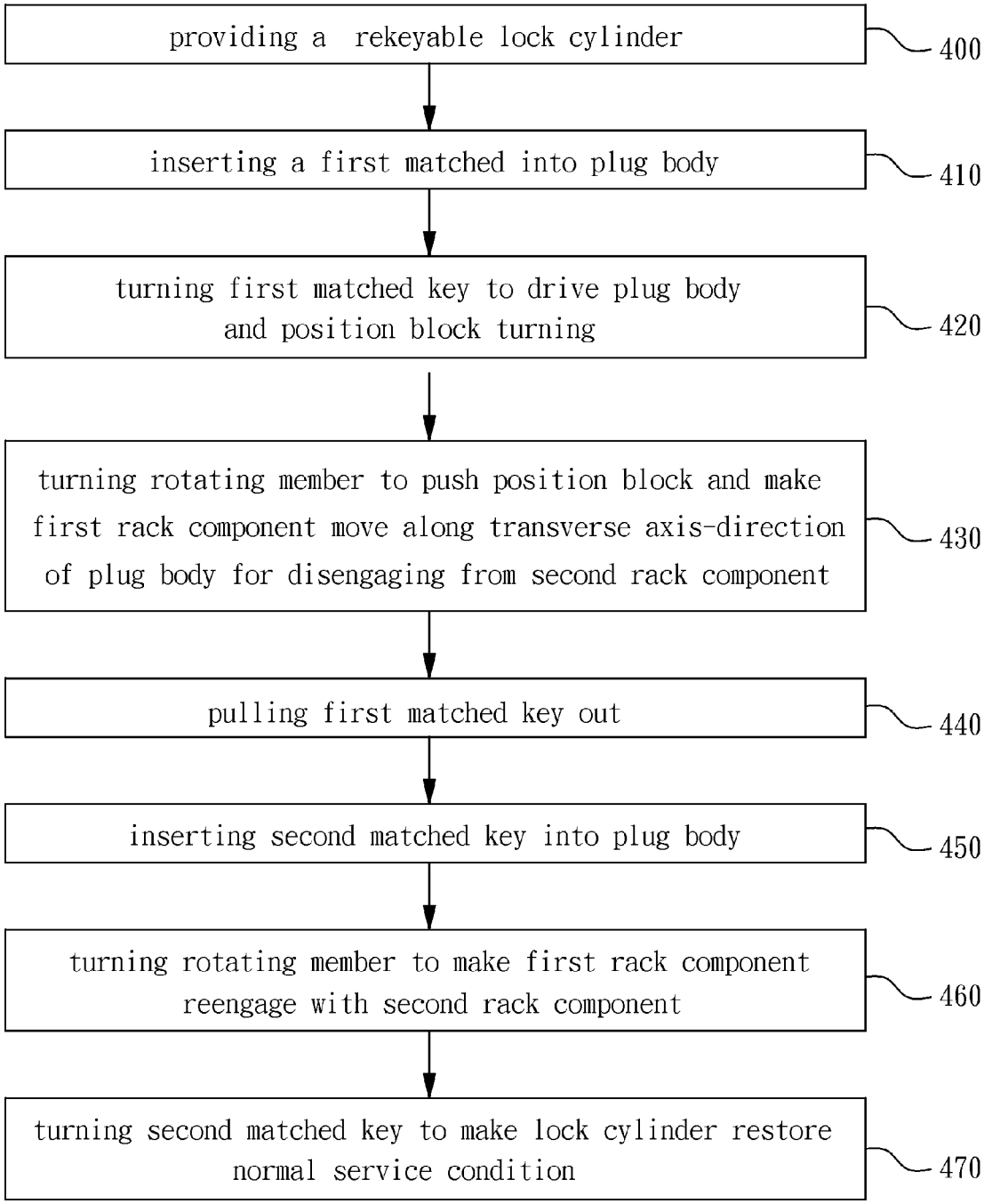
FIG. 5 is a flow chart for rekeying method of the rekeyable lock cylinder.
Figure 6:
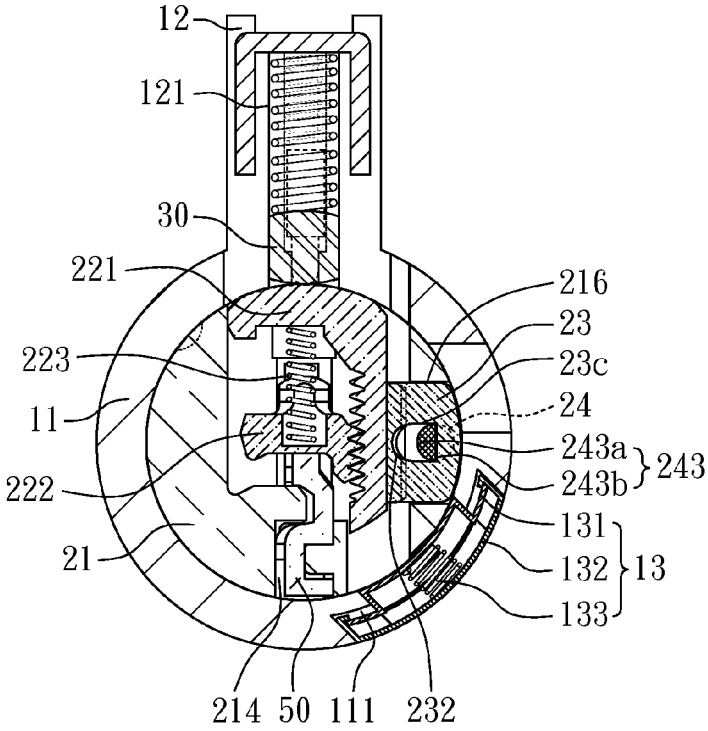
FIG. 6 is a longitudinal section view illustrating the first matched key is inserted into the rekeyable lock cylinder in accordance with a preferred embodiment of the present invention.
Figure 7:
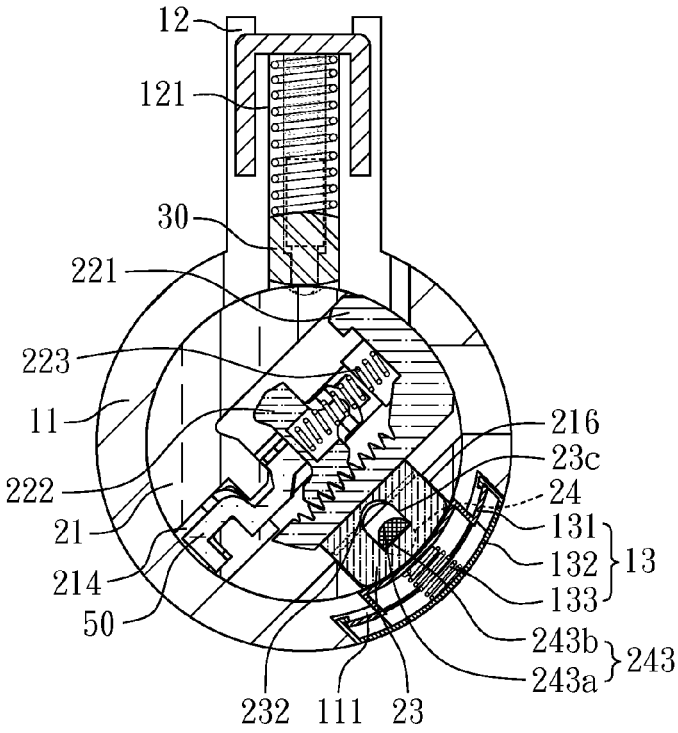
FIG. 7 is a longitudinal section view illustrating the first matched key is turned 45-degrees clockwise in accordance with a preferred embodiment of the present invention.
Figure 8:
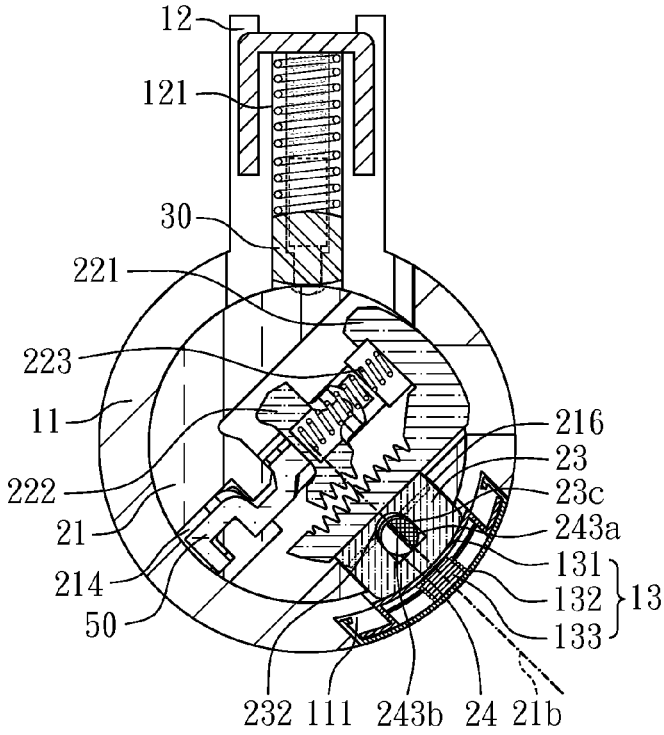
FIG. 8 is a longitudinal section view illustrating the rotating member is turned 90-degrees clockwise in accordance with a preferred embodiment of the present invention.
Figure 9:
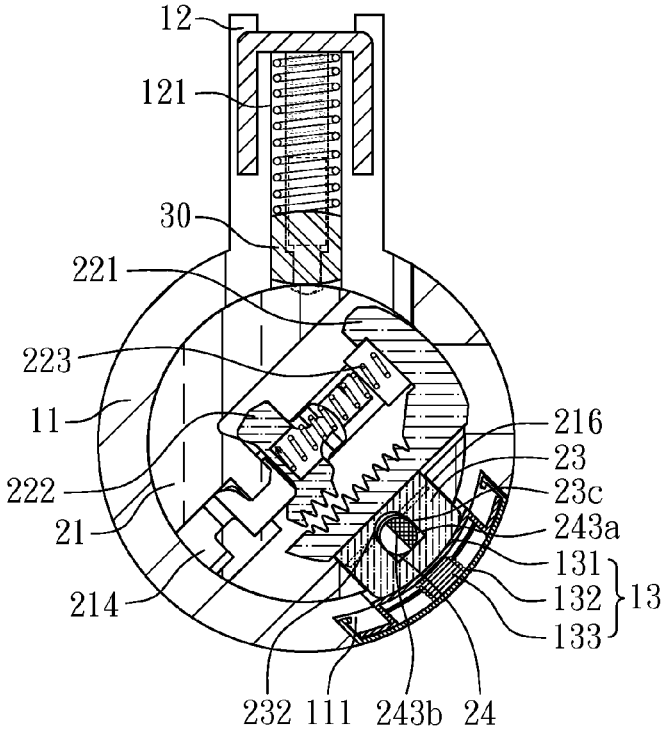
FIG. 9 is a longitudinal section view illustrating the first matched key is pulled out in accordance with a preferred embodiment of the present invention.
Figure 10:
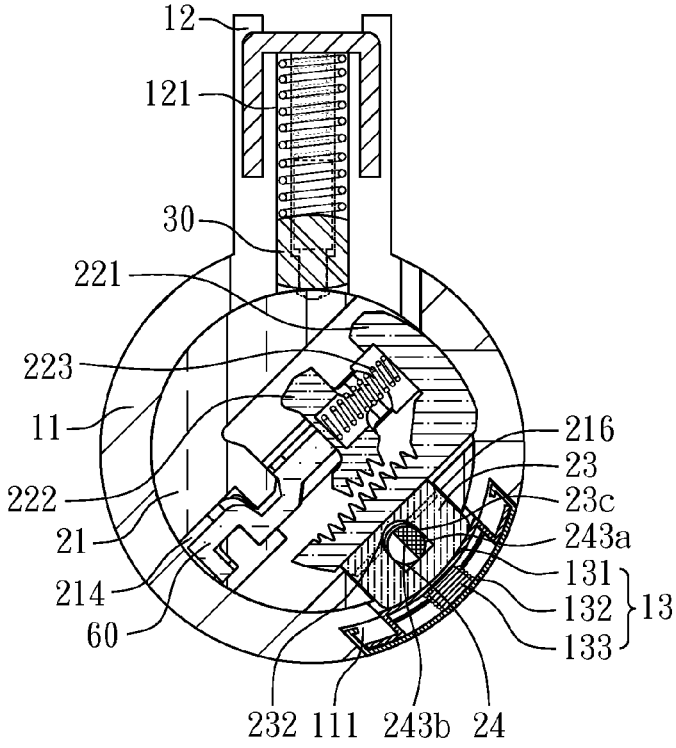
FIG. 10 is a longitudinal section view illustrating the second matched key is inserted into the rekeyable lock cylinder in accordance with a preferred embodiment of the present invention.
Figure 11:
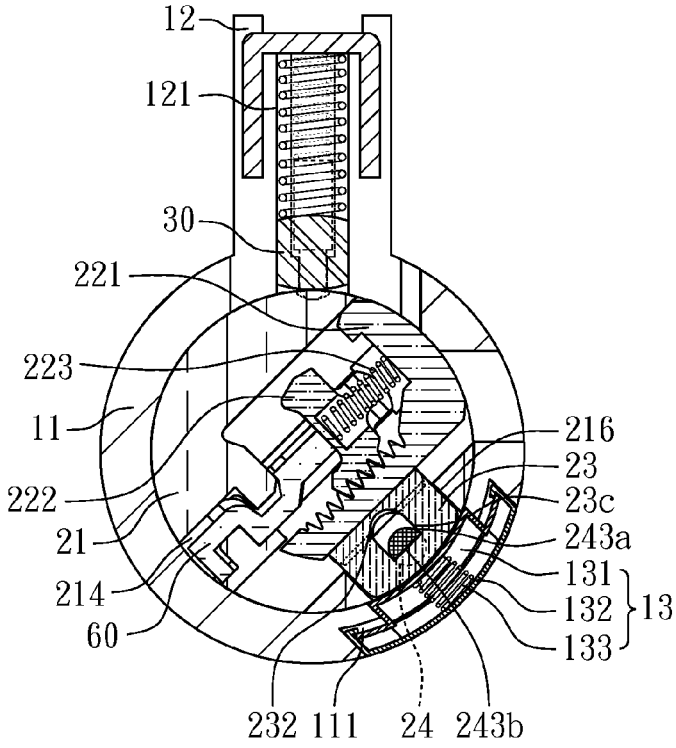
FIG. 11 is a longitudinal section view illustrating the rotating member is turned 90-degrees counterclockwise in accordance with a preferred embodiment of the present invention.
Figure 12:
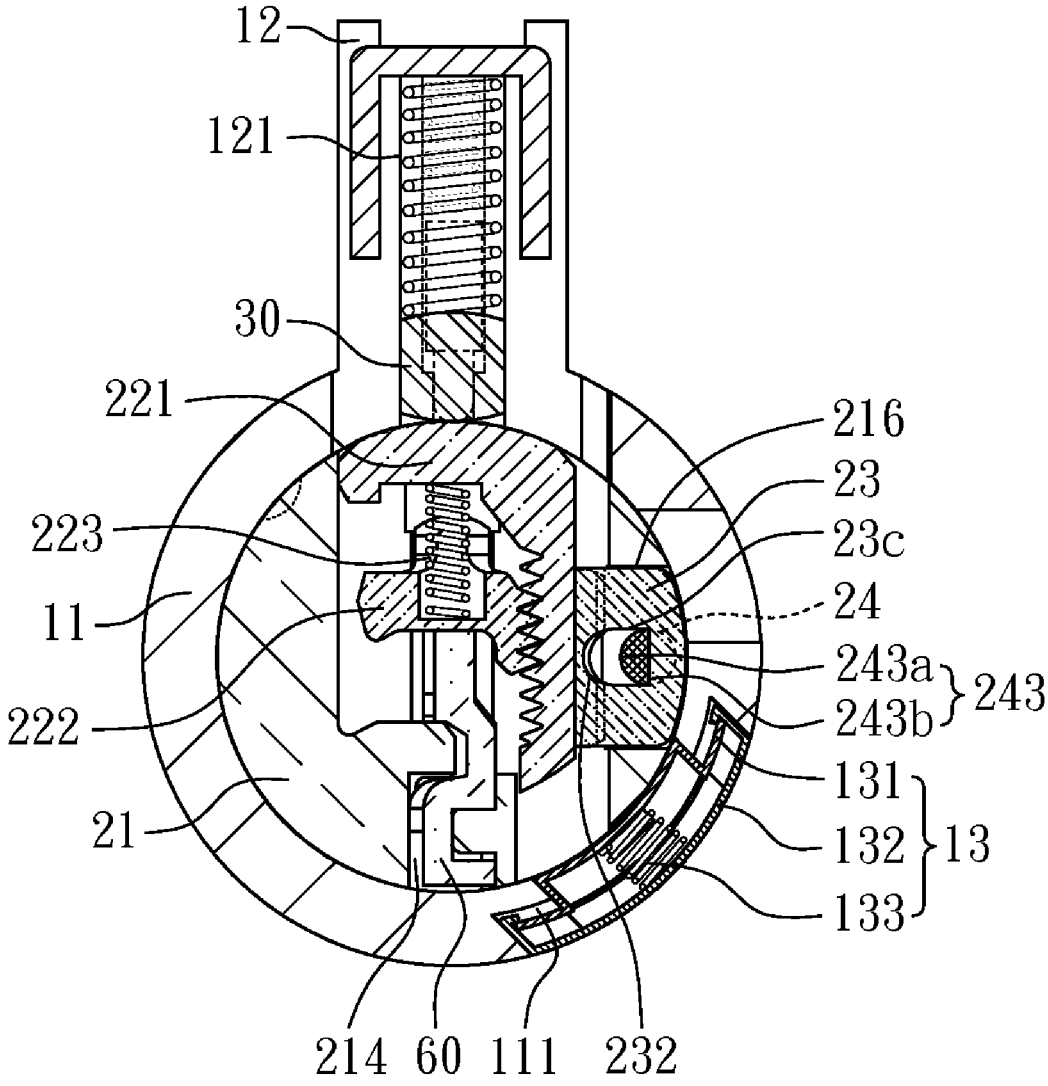
FIG. 12 is a longitudinal section view illustrating the rekeyable lock cylinder is in normal service condition in accordance with a preferred embodiment of the present invention.

FIG. 5 illustrates rekeying method of the rekeyable lock cylinder comprising "providing a rekeyable lock cylinder" step 400, "inserting a first matched into plug body" step 410, "turning first matched key to drive plug body and position block turning" step 420, "turning rotating member to push position block and make first rack component move along transverse axis-direction of plug body for disengaging from second rack component" step 430, "pulling first matched key out" step 440, "inserting second matched key into plug body" step 450, "turning rotating member to make first rack component reengage with second rack component" step 460 and "turning second matched key to make lock cylinder restore normal service condition" step 470. First, with reference to step 400 of FIG. 5, FIGS. 2 and 4, the rekeyable lock cylinder is formed by assembling the cylinder body 10, the plug assembly 20 and the upper pins 30 during "providing a rekeyable lock cylinder" step 400, wherein the arc sidewall 243*a* of the contacting portion 243 of the rotating member 24 doesn't contact against the inside wall 23*c* of the position block 23, the first rack components 221 are in engagement with the second rack components 222. Next, with reference to step 410 of FIG. 5 and FIG. 6, a first matched key 50 is inserted into the keyhole 214 of the plug body 21 during "inserting a first matched into plug body" step 410, wherein the first matched key 50 will push the assembled pins 22 to move up to rotating interface in this embodiment. Next, with reference to step 420 of FIG. 5 and FIG. 7, the first matched key 50 is turned to drive the plug body 21 and the position block 23 turning to a predetermined angular position during "turning first matched key to drive plug body and position block turning" step 420, wherein the first matched key 50 is turned 45-degrees clockwise, the position block 23 corresponds to the recession 111 of the hollow cylinder portion 11 and the resilient assembly 13, and also contacts against the movable plate 131 of the resilient assembly 13. Next, with reference to step 430 of FIG. 5 and FIGS. 2 and 8, the rotating member 24 is turned 90-degrees clockwise and then the contacting portion 243 of the rotating member 24 will push the inside wall 23*c* of the position block 23 that makes the position block 23 move along the transverse axis 21*b*-direction of the plug body 21 during "turning rotating member to push position block and make first rack component move along transverse axis-direction of plug body for disengaging with second rack component" step 430. In this embodiment, a tool (not shown in the drawing) can be used to insert into the tool-turning groove 241*a* for turning the rotating member 24, wherein the arc sidewall 243*a* of the contacting portion 243 will contact against the inside wall 23*c* of the position block 23 during turning the rotating member 24 and then the position block 23 is gradually pushed to the resilient assembly 13, so the movable plate 131 of the resilient assembly 13 will be pushed by the position block 23 to move to the immovable plate 132 and compress the resilient member 133. In this embodiment, a space needed for the position block 23 to move in can be provided by that the movable plate 131 moves away. Besides, the position block 23 is moved to drive the first rack components 221 moving along the transverse axis 21*b*-direction of the plug body 21 for disengaging from the second rack components 222. Next, with reference to step 440 of FIG. 5 and FIG. 9, the first matched key 50 is pulled out during "pulling first matched key out" step 440, wherein the second rack components 222 of the assembled pins 22 are pushed by the elastic components 223 to fall down to lowermost position when the first matched key 50 is pulled out in this embodiment. Next, with reference to step 450 of FIG. 5 and FIG. 10, a second matched key 60 is inserted into the keyhole 214 of the plug body 21 during "inserting second matched key into plug body" step 450, wherein the second rack components 222 of the assembled pins 22 will readjust height in accordance with different height of bitting of the second matched key 60 in this embodiment. Next, with reference to step 460 of FIG. 5 and FIG. 11, the rotating member 24 is turned 90-degrees counterclockwise to make the arc sidewall 243*a* of the contacting portion 243 of the rotating member 24 move away from the inside wall 23*c* of the position block 23, and meantime the position block 23 is pushed by the resilient member 133 of the resilient assembly 13 to restore and drive the first rack components 221 to reengage with the second rack components 222 during "turning rotating member to make first rack component reengage with second rack component" step 460. Finally, with reference to step 470 of FIG. 5 and FIG. 12, the second matched key 60 is turned to make the rekeyable lock cylinder restore normal service condition during "turning second matched key to make lock cylinder restore normal service condition" step 470.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A rekeyable lock cylinder comprising:

a cylinder body; and a plug assembly disposed within the cylinder body and comprising:

a plug body having a longitudinal axis, a transverse axis perpendicular to the longitudinal axis and a first through hole;

a plurality of assembled pins movably disposed in the plug body, wherein each of the assembled pins comprises a first rack component and a second rack component selectively engaging with the first rack component;

a position block disposed at the plug body having a plurality of pin runners for disposing the first rack components and a second through hole corresponding to the first through hole; and a rotating member installed penetrating the second through hole of the position block having a contacting portion located within the second through hole, wherein the position block is capable of being pushed by the contacting portion and moved along the transverse axis-direction of the plug body for disengaging the first rack components from the second rack components, wherein the cylinder body has a hollow cylinder portion for disposing the plug assembly and a resilient assembly, the hollow cylinder portion has an inner wall and a recession recessed from the inner wall, the resilient assembly is disposed within the recession;

wherein the resilient assembly comprises a movable plate is capable of being pushed to move by the position block and at least one resilient member contacting against the movable plate.

2. The rekeyable lock cylinder in accordance with claim 1, wherein the plug body has a front portion and a rear portion, the rear portion has a plurality of pin holes for disposing the assembled pins and a trench in communication with the pin holes, the position block is disposed within the trench, the first through hole penetrates the front portion and communicates with the trench.

3. The rekeyable lock cylinder in accordance with claim 2, wherein the rotating member has a first end and a second end, the contacting portion connects the first end and the second end, and the first end and the second end are pivotally disposed at the front portion and the rear portion respectively.

4. The rekeyable lock cylinder in accordance with claim 3, wherein the first end of the rotating member has a tool-turning groove.

5. The rekeyable lock cylinder in accordance with claim 1, wherein the rotating member is installed penetrating the first through hole of the plug body.

6. The rekeyable lock cylinder in accordance with claim 1, wherein the position block has a first side and a second side, the second through hole communicates with the first side and the second side.

7. The rekeyable lock cylinder in accordance with claim 1, wherein the position block has an inside wall located within the second through hole, the contacting portion of the rotating member has an arc sidewall, the arc sidewall of the contacting portion is capable of contacting against the inside wall of the position block.

8. The rekeyable lock cylinder in accordance with claim 7, wherein the contacting portion of the rotating member is in shape of semicircle.

9. The rekeyable lock cylinder in accordance with claim 7, wherein the contacting portion of the rotating member has a lateral disposed in opposition to the arc sidewall.

10. The rekeyable lock cylinder in accordance with claim 1, wherein the second through hole of the position block communicates with the pin runners.

11. The rekeyable lock cylinder in accordance with claim 1, wherein the movable plate has a surface facing the resilient member and at least one pillar projecting from the surface, the resilient member is disposed at the pillar.

12. The rekeyable lock cylinder in accordance with claim 1, wherein the resilient assembly further comprises an immovable plate fixed at the recession of the hollow cylinder portion, the resilient member is disposed between the movable plate and the immovable plate.

* * * * *